US008826794B1

(12) United States Patent
Marshall et al.

(10) Patent No.: US 8,826,794 B1
(45) Date of Patent: Sep. 9, 2014

(54) BREECH MECHANISM SLIDING CONTACT ASSEMBLY

(71) Applicants: David Marshall, Albany, NY (US); Adam Blot, Schenectady, NY (US)

(72) Inventors: David Marshall, Albany, NY (US); Adam Blot, Schenectady, NY (US)

(73) Assignee: The United States of America as Represented by the Secretary, Washington, DC (US)

( * ) Notice: Subject to any disclaimer, the term of this patent is extended or adjusted under 35 U.S.C. 154(b) by 0 days.

(21) Appl. No.: 13/790,190

(22) Filed: Mar. 8, 2013

(51) Int. Cl.
*F41A 3/00* (2006.01)
*F41A 3/10* (2006.01)

(52) U.S. Cl.
CPC ..... *F41A 3/10* (2013.01)
USPC ..... 89/24; 89/22; 89/17; 42/14

(58) Field of Classification Search
CPC ..... F41A 3/10
USPC ..... 89/22–25, 28.05, 17; 42/14
See application file for complete search history.

(56) References Cited

U.S. PATENT DOCUMENTS 3,738,219 A * 6/1973 Febres ..... 89/1.703
4,548,121 A * 10/1985 Janssen et al. ..... 89/26
5,014,592 A 5/1991 Zweig et al.
5,042,361 A 8/1991 Janssen et al.
5,078,051 A 1/1992 Amundson
H1121 H * 12/1992 Carroll et al. ..... 89/27.13
5,259,137 A * 11/1993 Blenk et al. ..... 42/16
5,271,327 A * 12/1993 Filo et al. ..... 102/207
5,604,325 A 2/1997 Balbo et al.
5,682,007 A * 10/1997 Dobbins ..... 89/187.02
6,202,532 B1 3/2001 Kadushin
7,201,094 B2 * 4/2007 Jebsen et al. ..... 89/189
7,681,483 B1 * 3/2010 Rhoades et al. ..... 89/29
7,698,987 B2 * 4/2010 Jebsen et al. ..... 89/191.01
7,779,740 B1 * 8/2010 Holmes et al. ..... 89/27.12
7,798,044 B2 9/2010 Webb
7,997,183 B2 * 8/2011 Jebsen et al. ..... 89/177
8,141,469 B1 * 3/2012 Holmes et al. ..... 89/17
8,272,307 B1 9/2012 Holmes et al.
8,272,313 B2 * 9/2012 Jebsen et al. ..... 89/182
8,281,699 B2 * 10/2012 Jebsen et al. ..... 89/24
8,307,750 B2 * 11/2012 Vuksanovich et al. .... 89/191.01
8,371,206 B1 2/2013 Albrecht et al.
2003/0056639 A1 * 3/2003 Giza ..... 89/1.701

* cited by examiner

*Primary Examiner* — Michael David
(74) *Attorney, Agent, or Firm* — Henry S. Goldfine

(57) ABSTRACT

A breech mechanism sliding contact assembly that allows for ignition, gun ground, and ammunition data link circuits to be broken while the breechblock is open. The sliding contact assembly further allows these circuits to be reconnected when the breechblock is closed. The breech mechanism sliding contact assembly comprises two separate connectors: a block slide connector that assembles to the breechblock and a ring slide connector that assembles to the breech ring. The two connectors operate in compact, pre-existing headspaces between the breechblock and the breech ring.

14 Claims, 14 Drawing Sheets

BREECH MECHANISM SLIDING CONTACT ASSEMBLY

GOVERNMENTAL INTEREST

The invention described herein may be manufactured and used by, or for the Government of the United States for governmental purposes without the payment of any royalties thereon.

FIELD OF THE INVENTION

The present invention relates to a breech mechanism for cannon, and it more particularly relates to a breech mechanism sliding contact assembly that provides power and data connections to the ignition, gun ground, and ammunition data link (ADL) interconnections from the breech ring to the breechblock of a gun breech mechanism, while still maintaining the open and close functionality of the breechblock.

BACKGROUND OF THE INVENTION

A cannon is generally designed to enable the delivery of a projectile over a great distance, or to enable the fired projectile to have greater armor penetration. However, when a rapid fire cannon is required, a sliding-wedge type of breech mechanism assembly is preferably used. This assembly is normally of simple construction and employs a rectangular wedge-shaped block securely seated in a slot in the breech ring, with its longitudinal axis perpendicular to the bore of the cannon tube. However, this assembly must necessarily be of a heavy section to provide the strength necessary to withstand the highly concentrated firing stresses produced therein.

In addition, the evolution of large caliber ordnance with sophisticated projectiles, firing systems, target proximity detection devices, precision arming and detonating circuits, and other electronic systems, have added to the complexity of transmitting power and data to the respective components. This problem is particularly accentuated with the limited accessibility to the breech block assembly without affecting the integrity of the ordnance.

Therefore, a need arises for a breech mechanism sliding contact assembly that provides power and data connections to the ignition, gun ground, and ammunition data link (ADL) interconnections from the breech ring to the breechblock of a gun, while still maintaining the open and close functionality of the breechblock. The need for such a breech mechanism sliding contact assembly has heretofore remained unsatisfied.

SUMMARY OF THE INVENTION

The present invention addresses the foregoing concerns and presents a new breech mechanism sliding contact assembly that allows for ignition, gun ground, and ammunition data link (ADL) circuits to be broken while the breechblock is open. The sliding contact assembly further allows these circuits to be reconnected when the breechblock is closed.

The sliding contact assembly provides power and data interconnections to the smart ammunition and the munitions firing contact, which are bundled together in the breechblock insert assembly. The data link provides bi-directional data flow to and from the smart round and fire control system, once the round is loaded into the chamber. The firing contact provides a path for electrical ignition of the round.

To this end, three signal interconnections and a system ground are packaged into two separate connectors: one that assembles to the breechblock and the other to the breech ring of the breech mechanism. The unique geometries of these components, allow for the sliding contact assembly to operate in a small, pre-existing area (or spacing) between the breechblock and the breech ring. This spacing is referred to as the "headspace."

The compact design of the sliding contact assembly also allows for the breechblock to be removed without having to disassemble either contact housing.

To this end, the sliding contact assembly includes two modules or slide connectors that fit within the breechblock headspace and the breech ring headspace. As a result, the sliding contact assembly allows for ignition, gun ground, and ammunition data link circuits to be broken while the breechblock is open. The sliding contact assembly further allows these circuits to be reconnected when the breechblock is closed.

The first module of the sliding contact assembly is the block slide connector, which is assembled to the breechblock within the breechblock headspace. The second module of the sliding contact assembly is the ring slide connector, which is assembled to the breech ring within the breech ring headspace. The compact design of the sliding contact assembly allows it to function in the head space areas of the breech mechanism, which minimizes the overall breech space claim.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
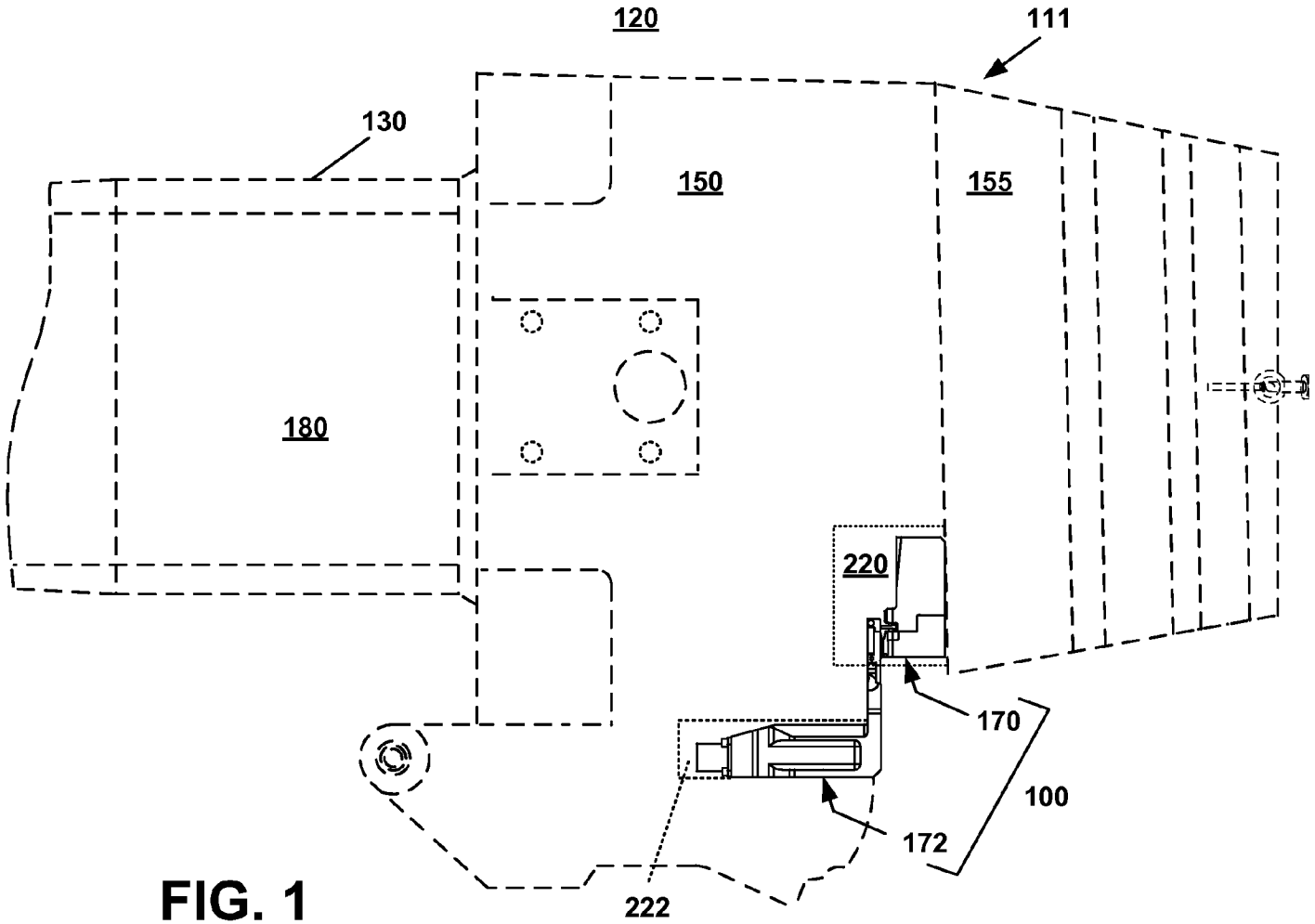
FIG. 1 is a side view of a sliding contact assembly that is comprised of a ring slide connector and a block slide connector according to one embodiment of the present invention, and that is shown mounted on a gun breech mechanism which is outlined in dashed lines for clarity of illustration.

With reference to FIG. 1, the present invention provides a new sliding contact assembly 100 that is designed for assembly to a breech mechanism 111 of a gun (or gun system) 120. In this particular exemplary embodiment, the gun 120 generally includes the breech mechanism 111 and a gun tube 130.

Figure 2:
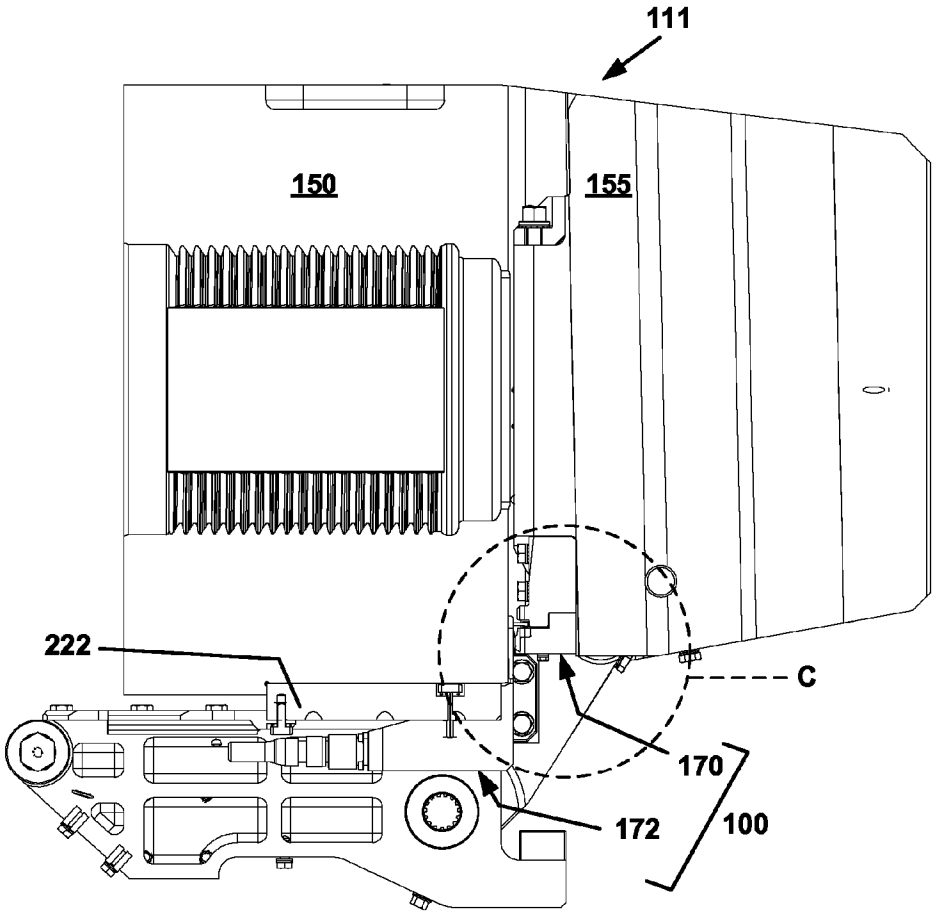
FIG. 2 is another side view of the sliding contact assembly of FIG. 1, invention, shown mounted on the breech mechanism of the gun that is illustrated in more detail in solid lines, without a gun tube.

The breech mechanism 111 is generally formed of a breech ring 150 and a breechblock 155, as is known or available in the field. As illustrated in FIGS. 1 and 2, the breech mechanism 111 defines two small chambers (or areas) 220, 222. The first chamber is defined between the breechblock 155 and the breech ring 150, and is referred to herein as the breechblock headspace 220. The second chamber is defined within the breech ring 150, and is referred to herein as the breech ring headspace 222.

Figure 3:
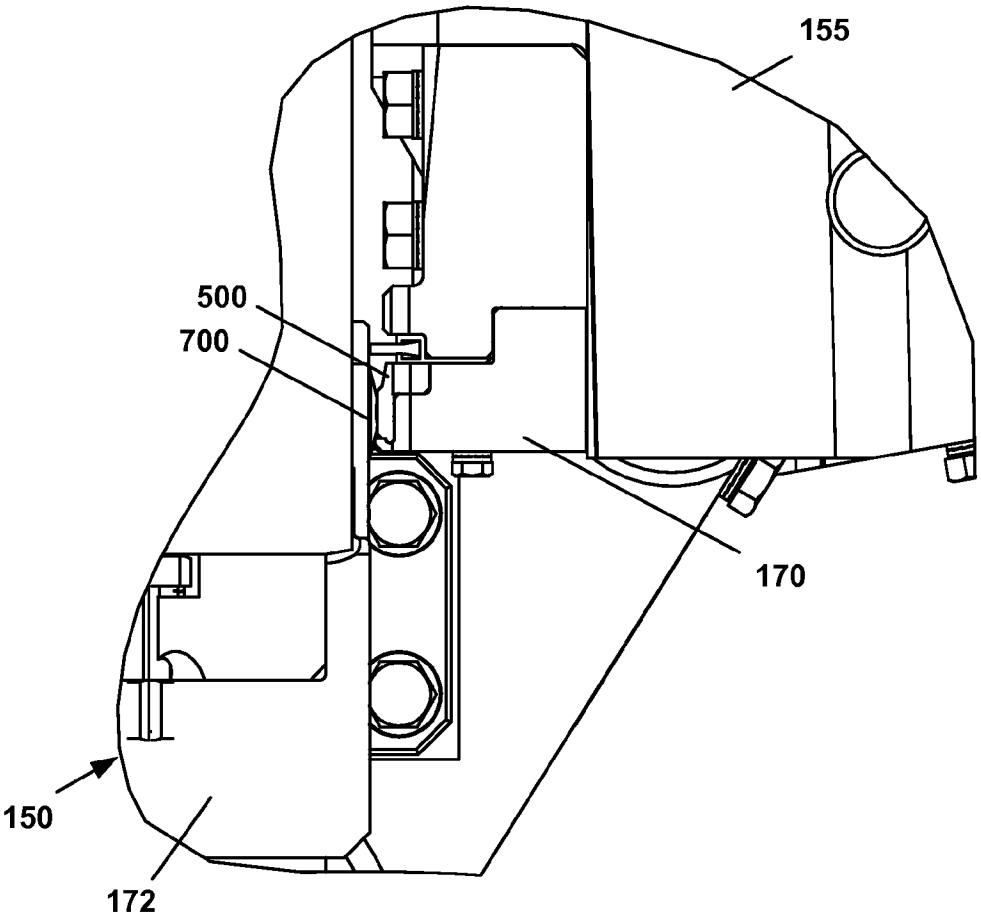
FIG. 3 is a greatly enlarged view of the block slide connector of FIG. 1, taken within detail circle C of FIG. 2.

With further reference to FIG. 3, the sliding contact assembly 100 includes two modules or slide connectors that fit within the breechblock headspace 220 and the breech ring headspace 222. As a result, the sliding contact assembly 100 allows for ignition, gun ground, and ammunition data link (ADL) circuits 250 to be broken while the breechblock 155 is open. The sliding contact assembly 100 further allows these circuits to be reconnected when the breechblock 155 is closed.

The first module of the sliding contact assembly 100 is referred to as the block slide connector 170 and is assembled to the breechblock 155 within the breechblock headspace 220, as it will be explained later in greater detail. The second module of the sliding contact assembly 100 is referred to as the ring slide connector 172 and is assembled to the breech ring 150 within the breech ring headspace 222, as it will be explained later in greater detail.

The unique geometries of the block slide connector 170 and the ring slide connector 172, allow for the sliding contact assembly 100 to operate with minimal design modification to the breech mechanism 111, or the operation of the gun 120.

The sliding contact assembly 100 provides a signal path for the firing and ADL circuits 250 from the breech ring 150 to the movable breechblock 155 while still allowing the breechblock 155 to operate as designed, thereby enabling communication with a smart munition (or round) 180 that is chambered in the gun tube 130.

The compact design allows the sliding contact assembly 100 to function in the head space areas 220, 222 of the breech mechanism 111, which minimizes the overall breech space claim. The reciprocating compression springs and unique contact designs of the sliding contact assembly 100 allow for the removal and installation of the breechblock 155 without having to remove either one of the block slide connector 170 or the ring slide connector 172 from the breech mechanism 111.

Figure 4:
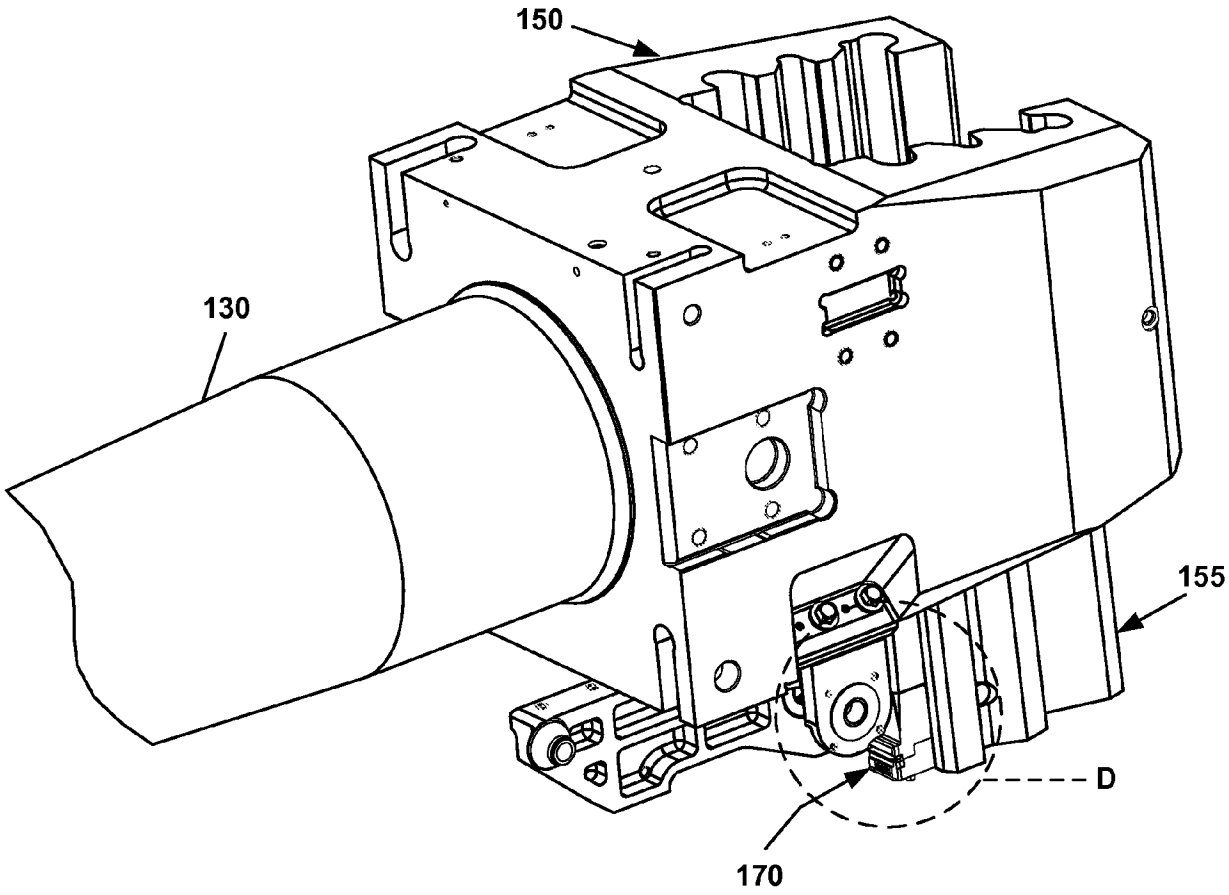
FIG. 4 is an enlarged view of the block slide connector of FIG. 1, shown secured to a breechblock of the gun breech mechanism.
Figure 5:
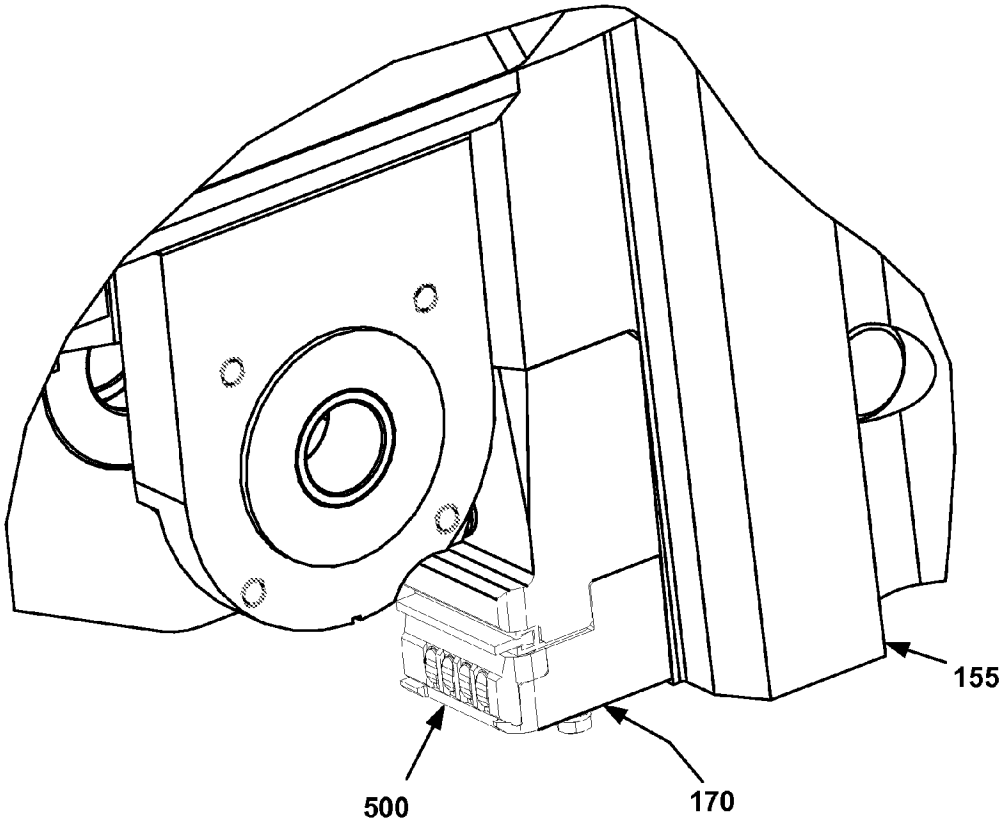
FIG. 5 is a greatly enlarged view of the block slide connector of FIG. 1, taken within detail circle D of FIG. 4.

Considering now the block slide connector 170 with reference to FIGS. 4 and 5, it is shown assembled to the breechblock 155. The breech mechanism 111 is illustrated in an open position, with the breechblock 155 disengaged from the breech ring 150. The block slide connector 170 terminates in a set of block slide connector contacts 500 that are positioned to engage and to establish electrical connection with a corresponding set of contacts (or contact assembly) 700 (FIG. 7) that form part of the ring slide connector 172, when the breech mechanism 111 is closed.

Figure 6:
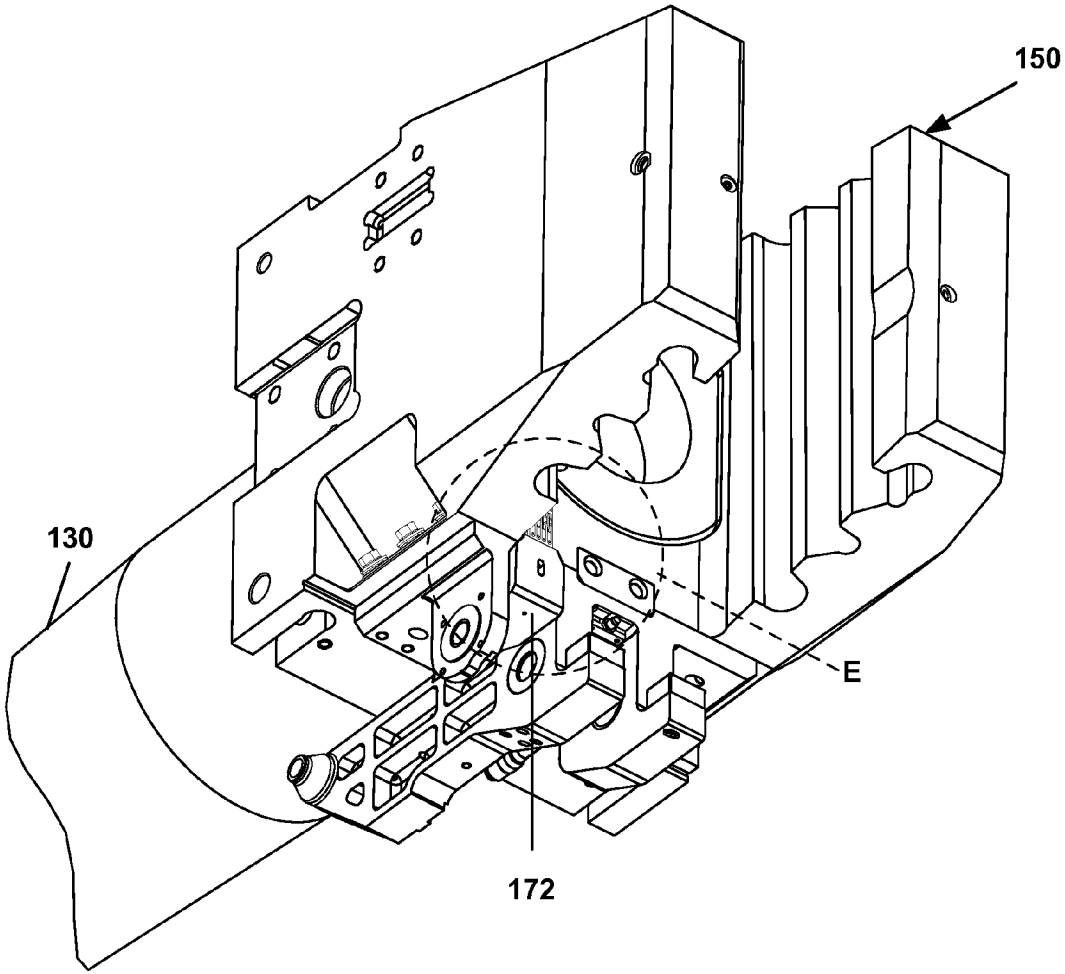
FIG. 6 is an enlarged view of the ring slide connector of FIG. 1, shown secured to a breech ring of the gun breech mechanism, with the breechblock removed for clarity of illustration.
Figure 7:
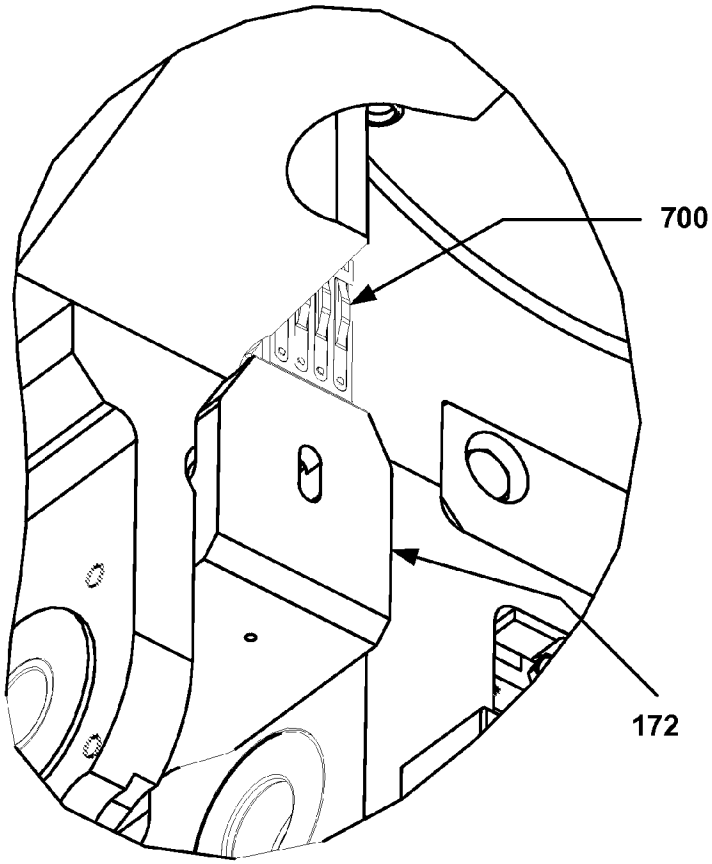
FIG. 7 is a greatly enlarged view of the ring slide connector of FIG. 1, taken within detail circle E of FIG. 6.

Considering now the ring slide connector 172 with reference to FIGS. 6 and 7, it is shown assembled to the breechblock 155. As with FIGS. 4 and 5, the breech mechanism 111 is illustrated in an open position. The ring slide connector 172 includes terminates in a set of ring slide connector contacts 700 that are positioned to engage and to establish electrical connection with the corresponding set of block slide connector contacts 500 (FIG. 5), upon closure of the breech mechanism 111.

The block slide connector 170 is assembled to the breechblock 155 of the breech mechanism 111 before the ring slide connector 172 is assembled to the breech ring 150 of the breech mechanism 111. The breechblock 155 can be installed with the breechblock 155 whether removed or assembled to the gun 120.

As the breechblock 155 opens and closes, compression springs 900 (FIG. 9) that are housed within the block slide connector 170 reciprocate in and out due to the "ramp" ring slide connector contacts 700 (FIG. 11) that are rigidly mounted within the ring slide connector 172. The compression springs 900 keep a constant force on both the block slide connector contacts 500 and the ring slide connector contacts 700, in order to maintain electrical connectivity until the breechblock 155 is opened again.

Figure 8:
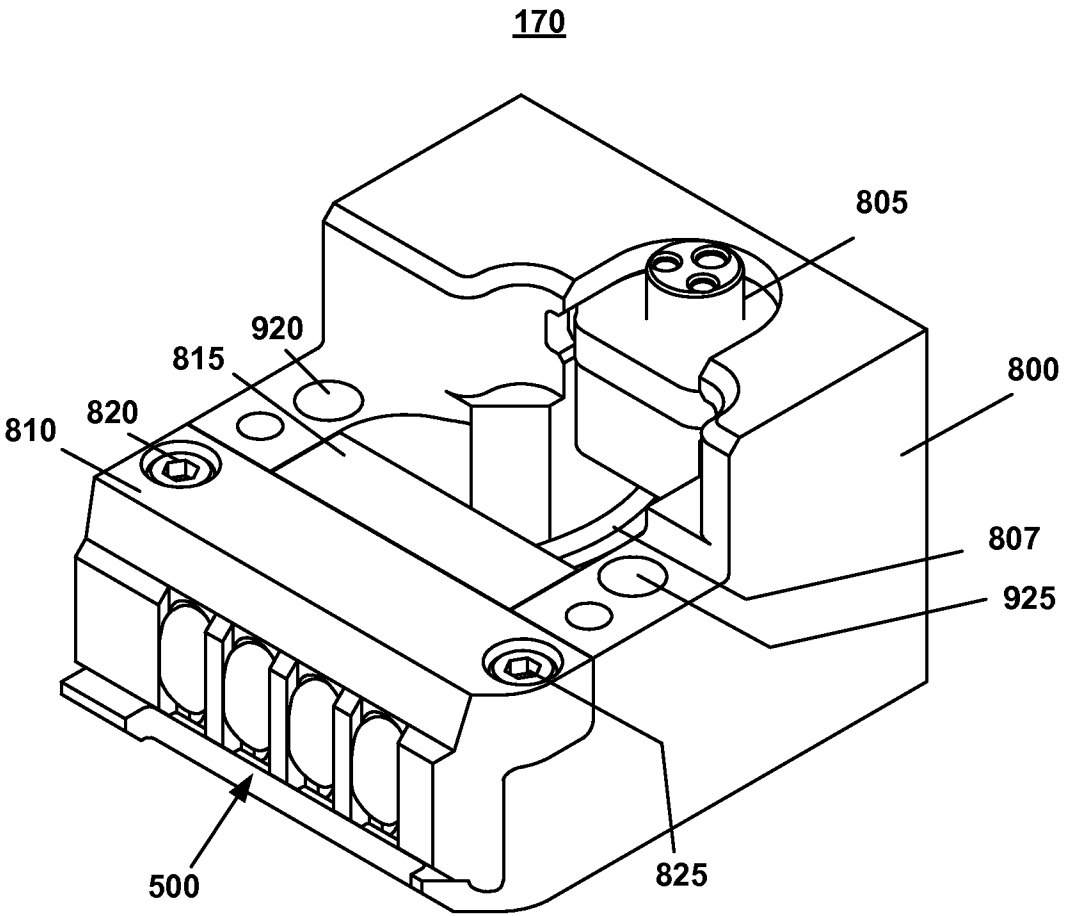
FIG. 8 is an isometric view of the block slide connector of FIG. 1.
Figure 9:
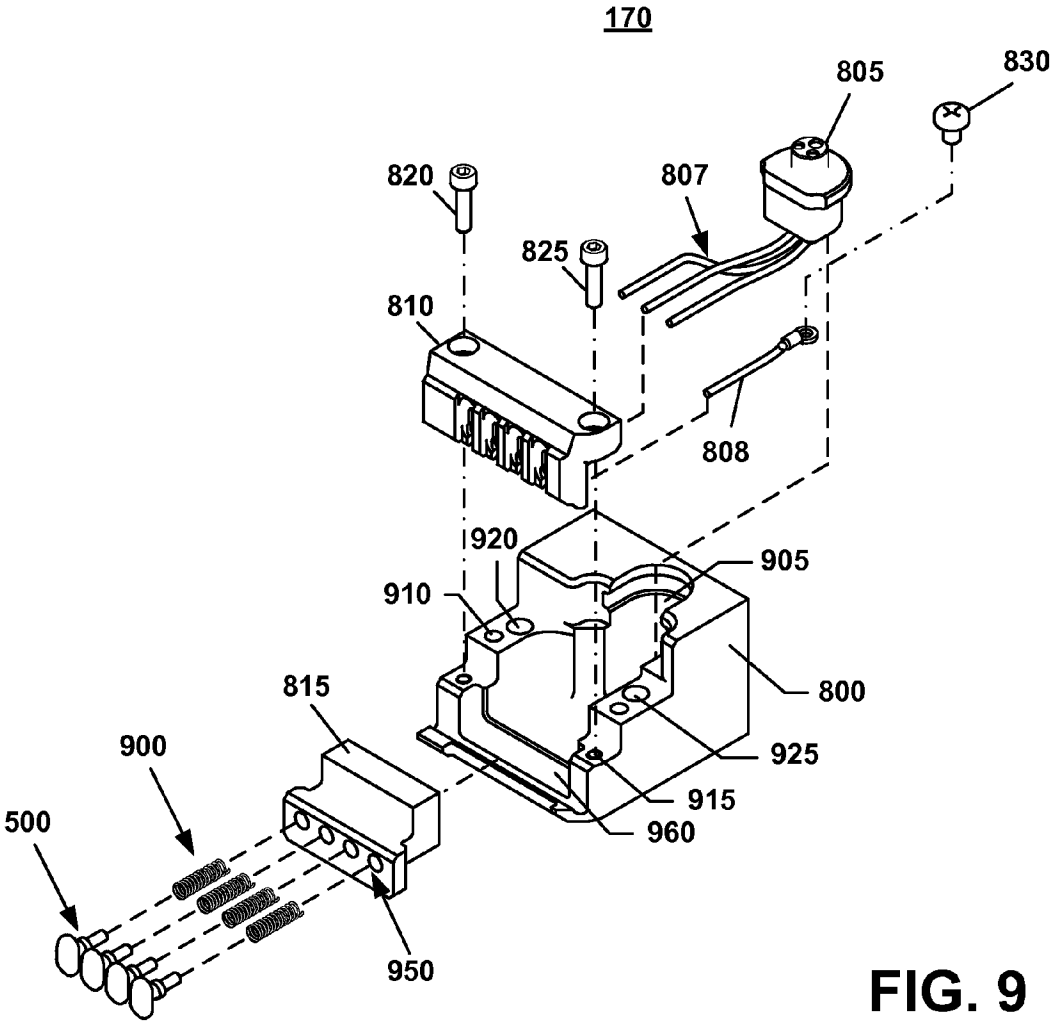
FIGS. 9 and 10 are exploded views of the block slide connector of FIG. 8.

The design, construction, and assembly of the block slide connector 170 will now be described in more detail in connection with FIGS. 8 through 11. FIGS. 8 and 9 illustrate the block slide connector 170 as generally comprising: a housing 800; an electrical connector 805; an insulator cover 810; an insulator block 815; two screws 820, 825; a set of compression springs 900; and a set of block slide connector sliding contacts 500.

The housing 800 is generally L-shaped and is preferably made of an electrically conductive material, such as steel, to provide a good connection to gun ground. The housing 800 defines an opening 905 in which the electrical connector 805 is firmly seated and secured. The housing 800 further includes a plurality of openings 910, 915, 920, 925 for receiving retaining screws, as it will be explained later in connection with FIGS. 10 and 11.

The electrical connector 805 provides connectivity to external power and/or data sources, for transmission to the various circuits 250 of the gun system 120, via a set of electrical conductors 807. Preferably, but not exclusively, the set of electrical conductors 807 includes three conductors of similar type and gauge. A ground wire 808 is connected at one end to ground by means of a screw 830, and further extends alongside the set of electrical conductors 807.

The insulator cover 810 and the insulator block 815 ensure the insulation of the set of electrical conductors 807 and the ground conductor 808.

The two screws 820, 825 lock both the insulator cover 810 and the insulator block 815 to the housing 800 by engaging the openings 910 and 920, respectively.

The set of compression springs 900 preferably includes four compression springs, one for each conductor of the set of electrical conductors 807 and the ground wire 808. The compression springs 900 are housed within four corresponding openings 950 formed within the insulator block 815.

The compression springs 900 abut at one of their ends a stop (or platform) 960 defined by the housing 800, and at their other ends, they abut the block slide connector sliding contacts 500. These sliding contacts 500 partly enter the openings 950 of the insulator block 815, and compress the compression springs 900.

The block slide connector 170 is assembled by seating and securing the electrical connector 805 within the opening 905 of the housing 800. The insulator block 815 is then seated against the stop 960 of the housing, and the insulator cover 810 is placed atop the insulator block 815. The insulator cover 810 is then fastened to the housing 800 by means of the screws 820, 825, thus securing both the insulator cover 810 and the insulator block 815 to the housing 800.

The electrical conductors 807, 808 are then passed through openings in the insulator cover 810 and the insulator block 815. The compression springs 900 are slipped over the electrical conductors 807, 808, and seated within the opening 950 of the insulator block 815. The ends of the electrical conductors 807, 808 that protrude through the compression springs 900 are secured to the tips of the corresponding block slide connector contacts 500, by for example, crimping or soldering.

Figure 10:
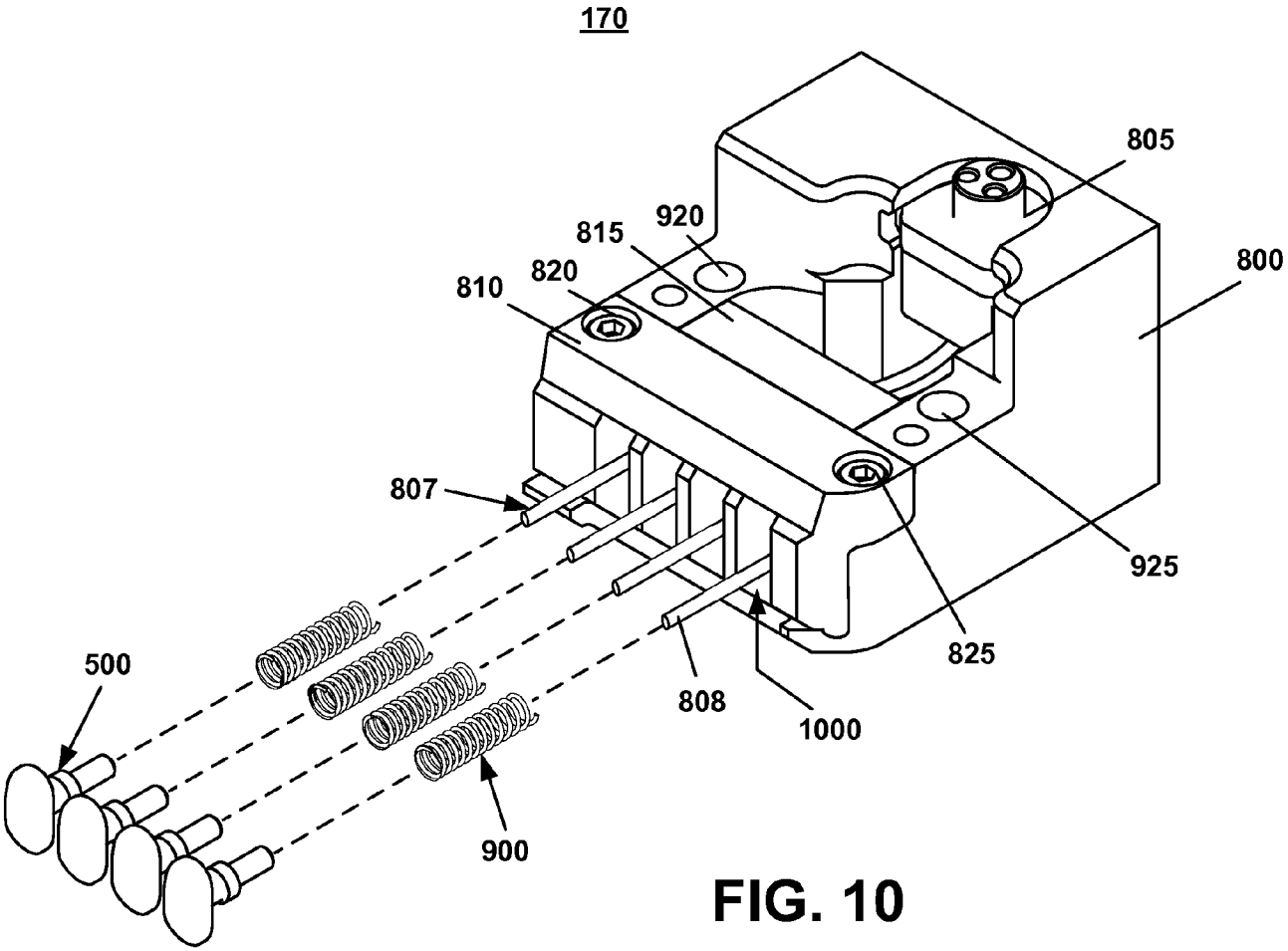

FIG. 10 shows a partly assembled block slide connector 170, in order to more clearly illustrate the electrical connection of the electrical conductors 807, 808 to the block slide connector contacts 500. To this end, the insulator cover 810 includes a plurality of openings, such as four openings 1000 through which the electrical conductors 807, 808 pass. The openings 1000 of the insulator cover 810 are co-aligned with the openings 950 of the insulator 815, in order to enable the electrical conductors 807, 808 to exit the housing 800.

Figure 11:
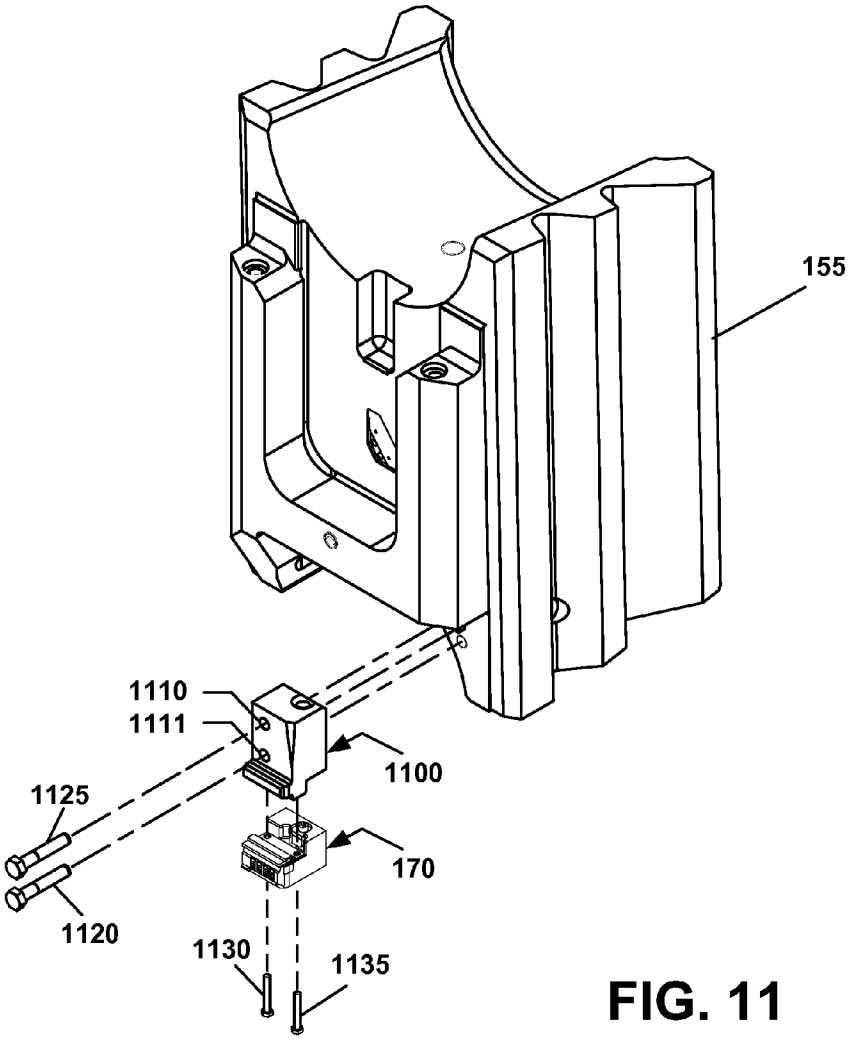
FIG. 11 is an assembly view of the block slide connector of FIG. 9, shown being assembled to the breechblock of the gun breech mechanism.

FIG. 11 is an assembly view of the block slide connector 170, shown being assembled to the breechblock 155 of the gun breech mechanism 111. To this end, a block adapter 1100 is used to secure the block slide connector 170 to the breechblock 155. The block adapter 1100 is shaped so that it complements the general shape of the block slide connector 170, in order to firmly retain the electrical connector 805 within the housing 800.

The block adapter 1100 is assembled to the block slide connector 170 by means of two mounting screws (or bolts) 1130, 1135. This assembly 170/1100 is then secured to the breechblock 155 by means of two mounting screws (or bolts) 1120, 1125 that penetrate two through openings 1110, 1111 formed in the block adapter 1100.

Figure 12:
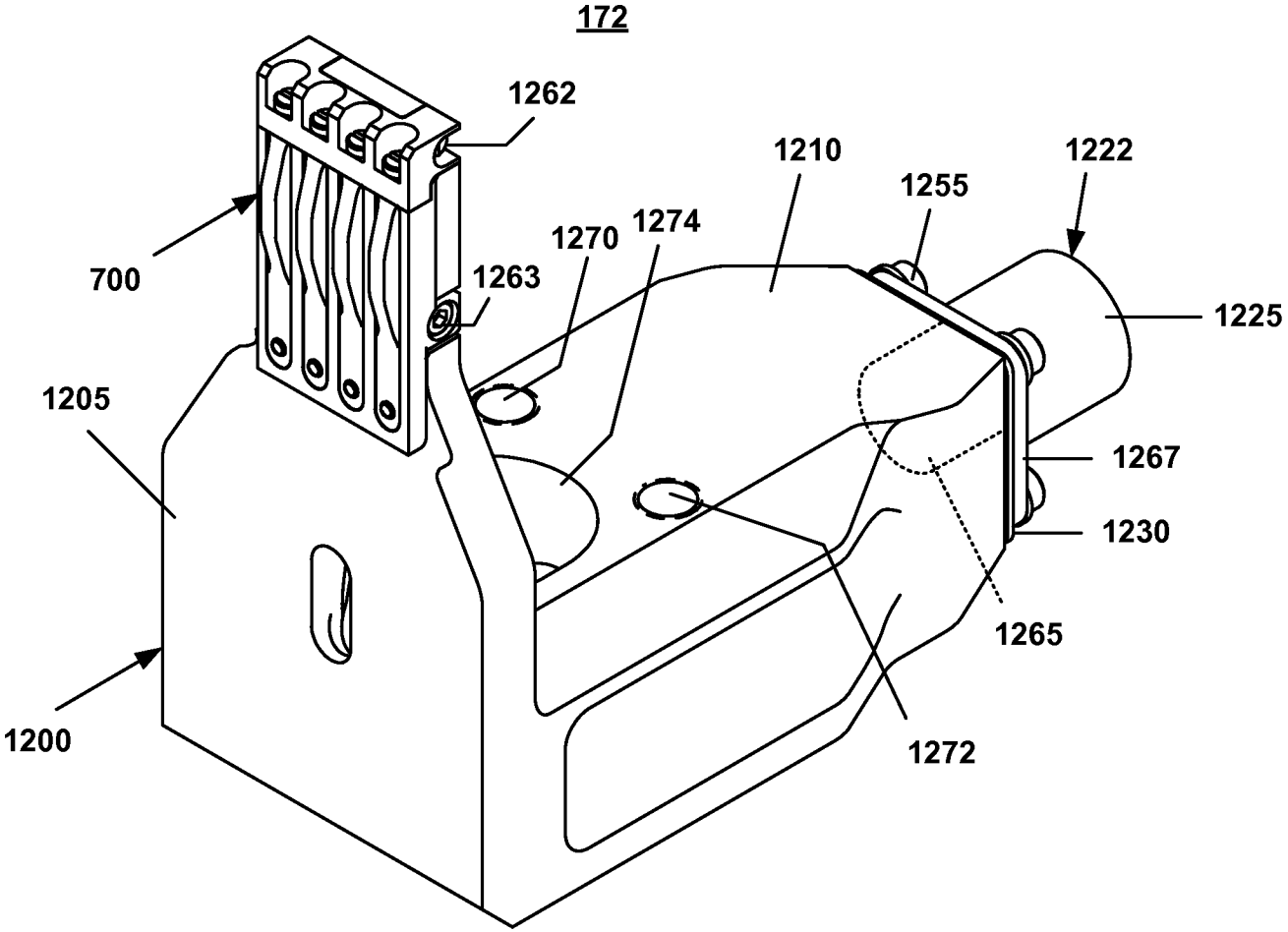
FIG. 12 is an isometric view of the ring slide connector of FIG. 1.
Figure 13:
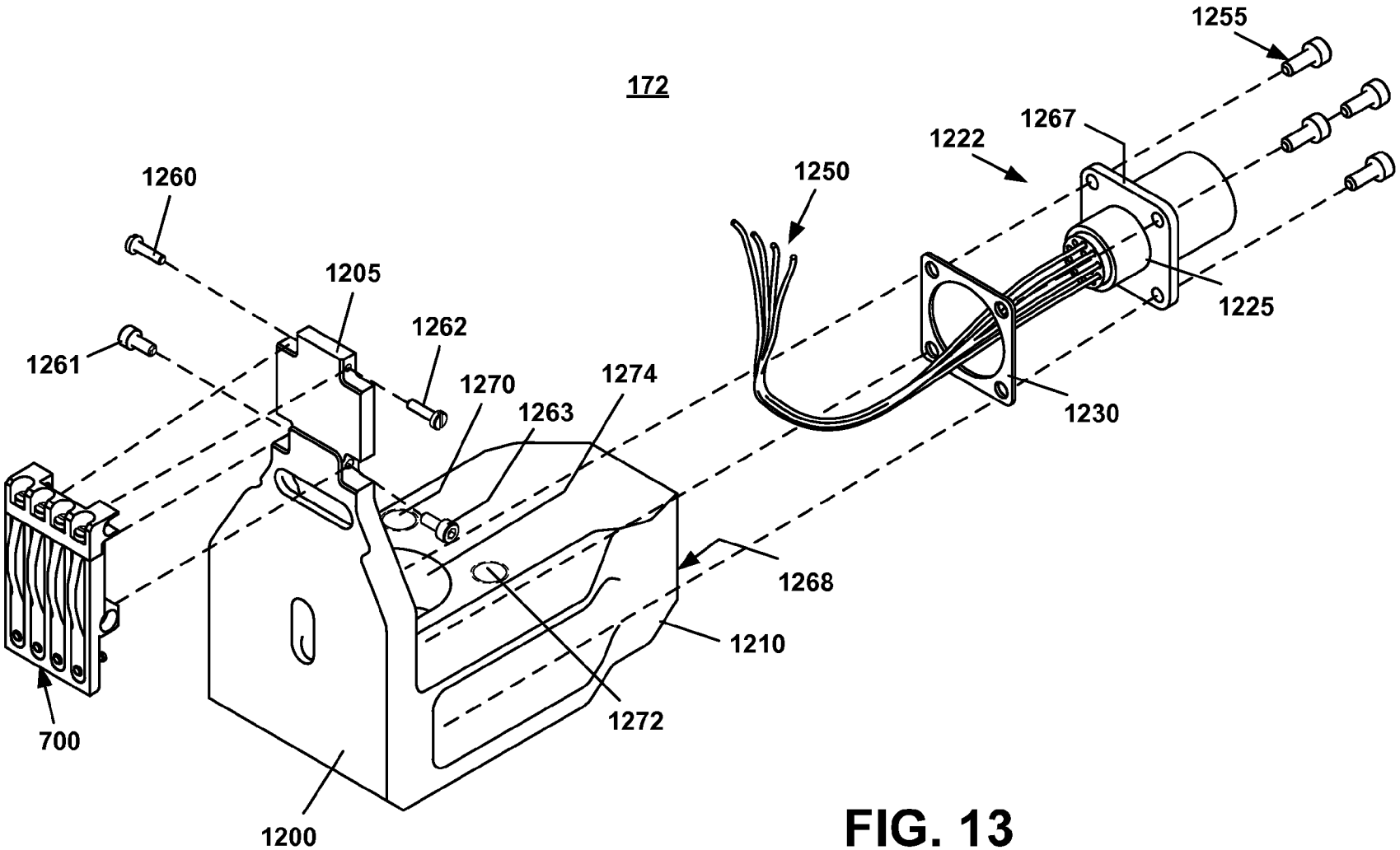
FIG. 13 is an exploded view of the ring slide connector of FIG. 11.

The design, construction, and assembly of the ring slide connector 172 will now be described in more detail in connection with FIGS. 12 through 14. FIGS. 12 and 13 illustrate the ring slide connector 172 as generally comprising: a housing (or body) 1200; an electrical connector assembly 1222; and the ring slide connector contacts 700.

The housing 1200 is generally L-shaped and is preferably made of an electrically insulating material, such as polyether ether keytone (PEEK) or nylon. The housing 1200 defines a platform 1205 that is integrally formed with a receptacle 1210. The platform 1205 and the receptacle 1210 are generally disposed at approximately 90 degrees relative to each other.

The platform 1205 is shaped in such a way as to engage the ring slide connector contacts 700 and to retain them securely by means of a set of four screws (or bolts) 1260, 1261, 1262, 1263.

The receptacle 1210 defines an opening 1265 (shown in a dotted line in FIG. 12) in which an electrical connector 1225 is firmly seated and secured. The receptacle 1210 further defines a plurality of openings 1270, 1272, 1274 whose function will be explained later in more detail.

The electrical connector assembly 1222 includes the electrical connector 1225, and insulator backing 1230, a set of conductors 1250, and a set of retaining screws (or bolts) 1255. The electrical connector 1225 provides connectivity to external power and/or data sources, for transmission to the smart munition180, via the set of electrical conductors 1250.

The electrical connector 1225 includes a flat shoulder 1267 that is assembled to a corresponding flat edge 1268 of the receptacle 1210 by means of a set of retaining screws 1255. The insulator backing 1230 is secured between the connector 1225 and the edge 1268 to provide added insulation to the connector 1225.

The set of conductors 1250 preferably includes four electrical conductors that correspond to the electrical conductors 807, 808, and to which they are electrically connected upon closing of the breechblock 155. To this end, the set of conductors 1250 are passed through the opening 1265 and extend from the opening 1274, for connection to the ring slide connector contacts 700.

Figure 14:
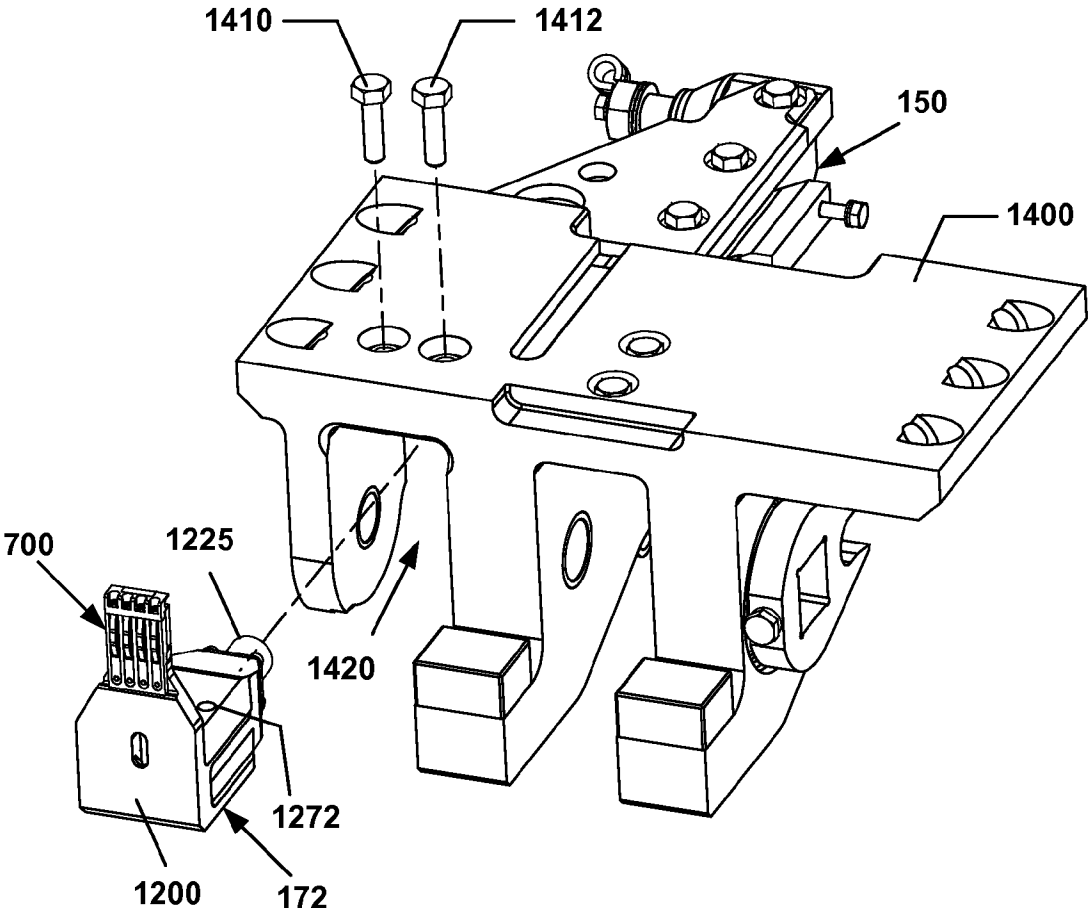
FIG. 14 is an assembly view of the ring slide connector of FIG. 12, shown being assembled to the ring block of the gun breech mechanism.

FIG. 14 is an assembly view of the ring slide connector 172, shown being assembled to the breech ring 150 of the gun breech mechanism 111. To this end, the receptacle 1210 of the housing 1200 is assembled to a platform 1400 of the breech ring 150 by inserting it in an existing, preformed clearance 1420, and by retaining it to the platform 1400 by means of two bolts 1410, 1412. The bolts 1410, 1412 engage respective openings 1270, 1272 in the receptacle 1210.

This assembly allows the ring slide connector contacts 700 to be readily exposed for contacting the block slide connector contacts 500 upon closing the breechblock 155, as shown in FIG. 3.

It should be understood that other modifications may be made to the present design without departing from the spirit and scope of the invention.

What is claimed is:

1. A sliding contact assembly for attachment to a breechblock and a breech ring of a gun system breech mechanism that defines a breechblock headspace and a breech ring headspace, the sliding contact assembly comprising:

a block slide connector that is assembled to the breechblock within the breechblock headspace;

a ring slide connector that is assembled to the breech ring within the breech ring headspace;

wherein the block slide connector includes:

a block slide housing;

an electrical connector that is assembled to the housing and that terminates in a set of conductors;

a set of compression springs that are assembled to the housing; and a set of block slide connector sliding contacts that are secured to the housing and that linearly translate under the action of the set of compression springs, and that are further secured to the set of conductors;

wherein the ring slide connector includes:

a ring slide housing;

an electrical connector assembly that is secured to the ring slide housing; and a set of ring slide connector contacts that are secured to the ring slide housing;

wherein the set of ring slide connector contacts slidably engage and establish electrical connection with the set of block slide connector sliding contacts upon closure of the breech mechanism; and wherein the set of ring slide connector contacts disengage from the set of block slide connector sliding contacts upon opening of the breech mechanism.

2. The sliding contact assembly according to claim 1, wherein the breechblock headspace is defined by the breechblock and the breech ring.

3. The sliding contact assembly according to claim 1, wherein the breech ring headspace is defined within the breech ring.

4. The sliding contact assembly according to claim 1, wherein the block slide connector further includes an insulator cover and an insulator block.

5. The sliding contact assembly according to claim 1, wherein the block slide housing is made of an electrically insulating material.

6. The sliding contact assembly according to claim 5, wherein the electrically insulating material is selected from a group consisting essentially of polyether ether keytone and nylon.

7. The sliding contact assembly according to claim 1, wherein the ring slide housing is made of an electrically insulating material.

8. The sliding contact assembly according to claim 5, wherein the electrically insulating material is selected from a group consisting essentially of polyether ether keytone and nylon.

9. The sliding contact assembly according to claim 1, wherein the ring slide housing is generally L-shaped.

10. The sliding contact assembly according to claim 9, wherein the ring slide housing defines a platform that is integrally formed with a receptacle.

11. The sliding contact assembly according to claim 10, wherein the platform and the receptacle are generally disposed at approximately 90 degrees relative to each other.

12. The sliding contact assembly according to claim 11, wherein the platform engages the set of ring slide connector contacts.

13. The sliding contact assembly according to claim 12, wherein the receptacle houses at least in part, the electrical connector assembly.

14. The sliding contact assembly according to claim 13, wherein the set of ring slide connector contacts includes a set of electrical conductors that extend through the receptacle to be secured to the set of ring slide connector contacts.

* * * * *